US006726830B2

(12) United States Patent
Mabuchi et al.

(10) Patent No.: US 6,726,830 B2
(45) **Date of Patent: *Apr. 27, 2004**

(54) STEEL STRIP DESCALING APPARATUS AND A STEEL STRIP MANUFACTURING APPARATUS USING THE DESCALING APPARATUS

(75) Inventors: Katsumi Mabuchi, Hitachi (JP); Tomoko Kikuchi, Hitachinaka (JP); Yasunobu Kani, Hitachi (JP); Tsuneo Nakamura, Hitachi (JP); Shinichi Yokosuka, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 155 days.

This patent is subject to a terminal disclaimer.

(21) Appl. No.: 09/978,567

(22) Filed: Oct. 18, 2001

(65) Prior Publication Data

US 2002/0033344 A1 Mar. 21, 2002

Related U.S. Application Data

(62) Division of application No. 09/378,768, filed on Aug. 23, 1999, now Pat. No. 6,325,913.

(30) Foreign Application Priority Data

Aug. 24, 1998 (JP) ..... 10-237231

(51) Int. Cl.[7] ..... C25D 17/00; C25B 9/00; C25B 15/00

(52) U.S. Cl. ..... 205/712; 205/670; 205/671; 205/672

(58) Field of Search ..... 205/712, 670, 205/671, 672

(56) References Cited

U.S. PATENT DOCUMENTS 4,374,719 A 2/1983 Bakewell et al.
6,325,913 B1 * 12/2001 Mabuchi et al. ..... 205/670

FOREIGN PATENT DOCUMENTS

| | | |
|---|---|---|
| EP | 086 115 | 8/1983 |
| EP | 086115 A1 * | 8/1983 |
| EP | 870 854 | 10/1998 |
| JP | 3-56699 | 3/1991 |
| JP | 8-100299 | 4/1996 |

* cited by examiner

*Primary Examiner*—Arun S. Phasge
(74) *Attorney, Agent, or Firm*—Mattingly, Stanger & Malur, P.C.

(57) ABSTRACT

This invention relates to an improved apparatus and method for electrolytic descaling of steel strips. The apparatus comprises electrodes integrated with nozzles having jet openings for dispensing electrolyte onto the surface of the steel strips. By jetting the electrolyte to the steel strip in the air and applying a voltage to the electrode, the scale on the surface of the steel strip is removed. This jetting of electrolyte reduces the size requirement of the electrolyte tank storing the electrolyte because the required quantity of electrolyte decreases. The present invention does not require immersion of the electrodes in the electrolyte and thus avoids the problem of short-circuiting that occurs with submerged electrodes. This results in a significant improvement in electric power efficiency. By individually adjusting the jet pressure of the electrolyte jets, the waving and the flexure of the steel strip is prevented and the electrodes can be arranged close to the steel strip to reduce required electric power. With the reduction in short circuit currents, many electrodes can be provided and the speed of the descaling can be increased as a result of the increase in electric current to the steel strip.

4 Claims, 6 Drawing Sheets

STEEL STRIP DESCALING APPARATUS AND A STEEL STRIP MANUFACTURING APPARATUS USING THE DESCALING APPARATUS

This is a divisional application of U.S. Ser. No. 09/378,768 filed Aug. 23, 1999 now U.S. Pat. No. 6,325,913.

The present invention relates to a steel strip descaling apparatus and a steel strip manufacturing apparatus using the descaling apparatus.

BACKGROUND OF THE INVENTION

A technique that removes an oxide (scale) formed on the surface of steel strips by electrolyzing scale in solutions such as a neutral salt, a nitrate and a sulfate is known.

The Japanese patent Laid-open No. 3-56699 describes pumping an electrolyte to a steel strip submerged in the electrolyte from the hole of an electrolyte in order to prevent the steel strip from waving.

The Japanese patent Laid-open No. 8-100299 describes spraying an electrolyte to a steel strip in the air in order to apply an electric current.

SUMMARY

However, in the art of No. 3-56699, because electrolyte and an electric conductor do not contact each other directly, a large quantity of electrolyte is necessary. The apparatus is large because of a large electrolyte bath. As the electrodes are also located in the electrolyte, a third disadvantage of this prior art technique is that short circuits occur among the electrodes through the electrolyte.

In the art of No. 8-100299, because whirls occur between an electrode and the steel strip, electric current provided to the steel strip from the electrodes is small and the electric current is variable. Therefore the steel strip is not descaled rapidly and uniformly because of the variable electric current. We can not produce a steel strip which has uniformly beautiful surfaces with this art.

The present invention relates to a steel strip descaling apparatus and a steel strip manufacturing apparatus.

The purpose of the present invention is to provide the steel strip descaling apparatus and the steel strip manufacturing apparatus which improve the electric power efficiency, processing speed and miniaturization.

To achieve the above purpose, a feature of the present invention is that electrodes have jet openings which jet the electrolyte to the steel strip, that is to say, the electrode is integrated with the nozzle which jets an electrolyte.

With these electrodes, by jetting the electrolyte to the steel strip in the air and applying a voltage to the electrode, the scale (oxide coating or layer)on the surface of the steel strip is removed.

According to a feature of the present invention, it is possible to reduce the size of an electrolyte tank storing the electrolyte, because the quantity of an electrolyte decreases by jetting the electrolyte in the air. Therefore, the descaling apparatus is miniaturized.

In contrast to the conventional art wherein the steel to be treated is submerged in the electrolyte, the present invention's use of jetting means for jetting the electrolyte onto the steel strip obviates immersion of the steel strip and the occurrence of short-circuit electric current between the electrodes, thus improving electric power efficiency.

Because the electrolyte jetted from the jet opening contacts an conductor applied the voltage, we can supply large electric current to the steel strip through the jetted electrolyte.

Therefore, the electric current density of the steel strip is large and the steel strip is descaled rapidly.

Providing many electrodes improves the speed of the descaling because the electric current density in the steel strip increases.

Another feature of the present invention is that the descaling apparatus further has force adjustment of the jetted electrolyte.

By adjusting the force of the jetted electrolyte, the waving and the flexure of the steel strip is prevented, and we can arrange the electrodes close to the steel strip.

Because the electrodes are moved closer to the steel strip, a voltage drop between the electrodes and the steel strip becomes lower, and the electric power for the descaling can be decreased.

By using the above-mentioned descaling apparatus, the steel strip manufacturing apparatus attains an improvement in electric power efficiency and the processing speed, and the manufacturing apparatus becomes small.

EMBODIMENTS

EXAMPLE 1

Figure 1:
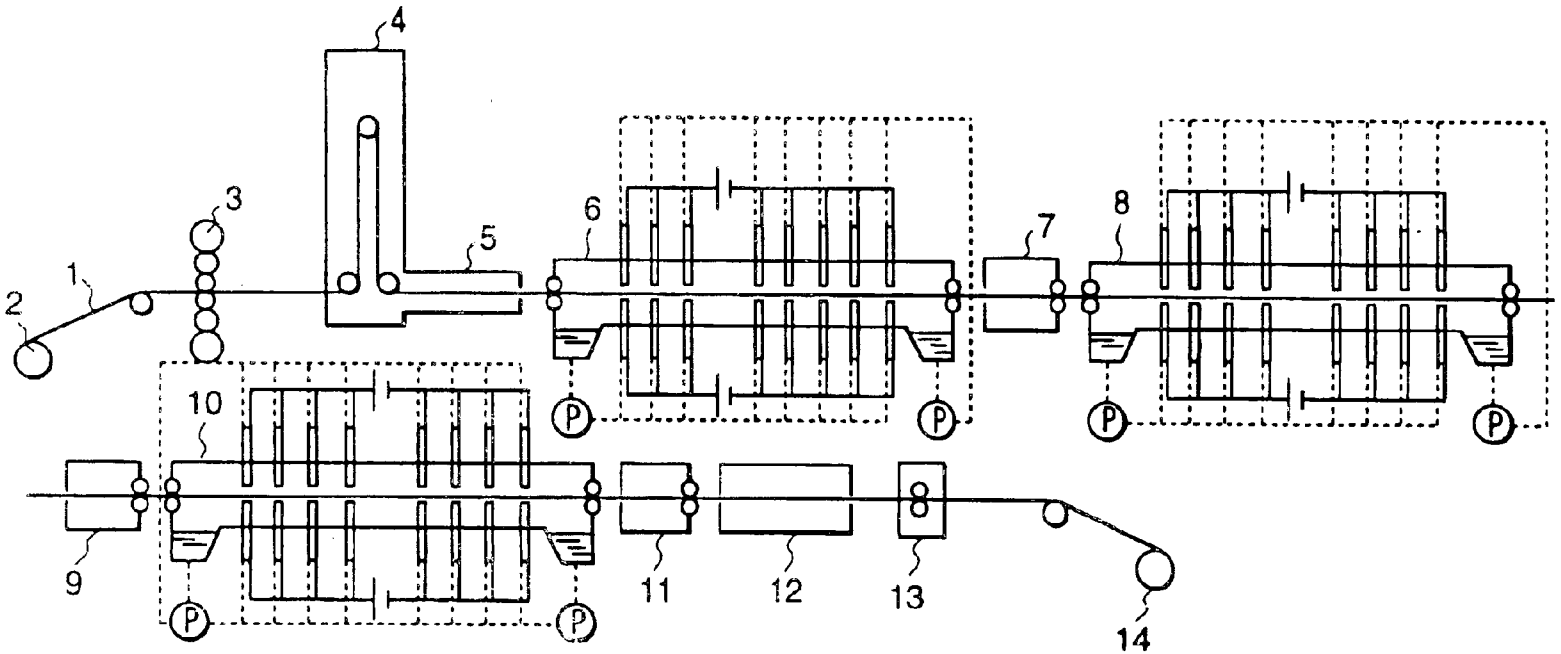
FIG. 1 shows the stainless steel strip manufacturing apparatus of the first example.

The stainless steel strip manufacturing apparatus according to the first embodiment of the present invention is explained with respect to FIG. 1.

The steel strip 1 unwound from the pay off reel 2 is rolled by the cold rolling mill 3 and is annealed in the annealing hearth 4 for the heat characteristic improvement of the ductility and the like. At this time, a scale that is a thin oxide film such as a chrome oxide, an iron oxide and so on, is formed on the surface of the steel strip 1 and causes a quality declination.

The rolled steel strip 1 passes through the cooling hearth 5 and passes through the neutral salt solution electrolysis part 6 that is the first electrolysis part. In the neutral salt solution electrolysis part 6, with the neutral salt solution 20 (shown in FIG. 2) as a sulfate sodium solution, chrome oxide is eliminated.

Next, the steel strip 1 passes through the alkali solution electrolysis part 8 that is the middle electrolysis cell via washing tank 7. Next, the steel strip 1 passes through the nitrate solution electrolysis part 10 via washing tank 9. In the alkali solution electrolysis part 8, with a sodium hydroxide solution, a very small quantity of oxide such as a copper oxide, niobium oxide is eliminated. In the nitrate solution electrolysis part 10, with a nitrate solution, an iron oxide is eliminated. It is possible to substitute the nitric acid and hydrofluoric acid for the nitrate solution. In accordance with the kind of stainless steel, the processing is possible to perform without the alkali solution electrolysis part 8 and washing tank 9. The processing temperature and the density of the electrolyte solution are the same as the conventional processing.

Finally, the steel strip 1 is wound to the reel 14 via the washing tank 11, the drier 12 and the skin pass roller 13.

Figure 2:
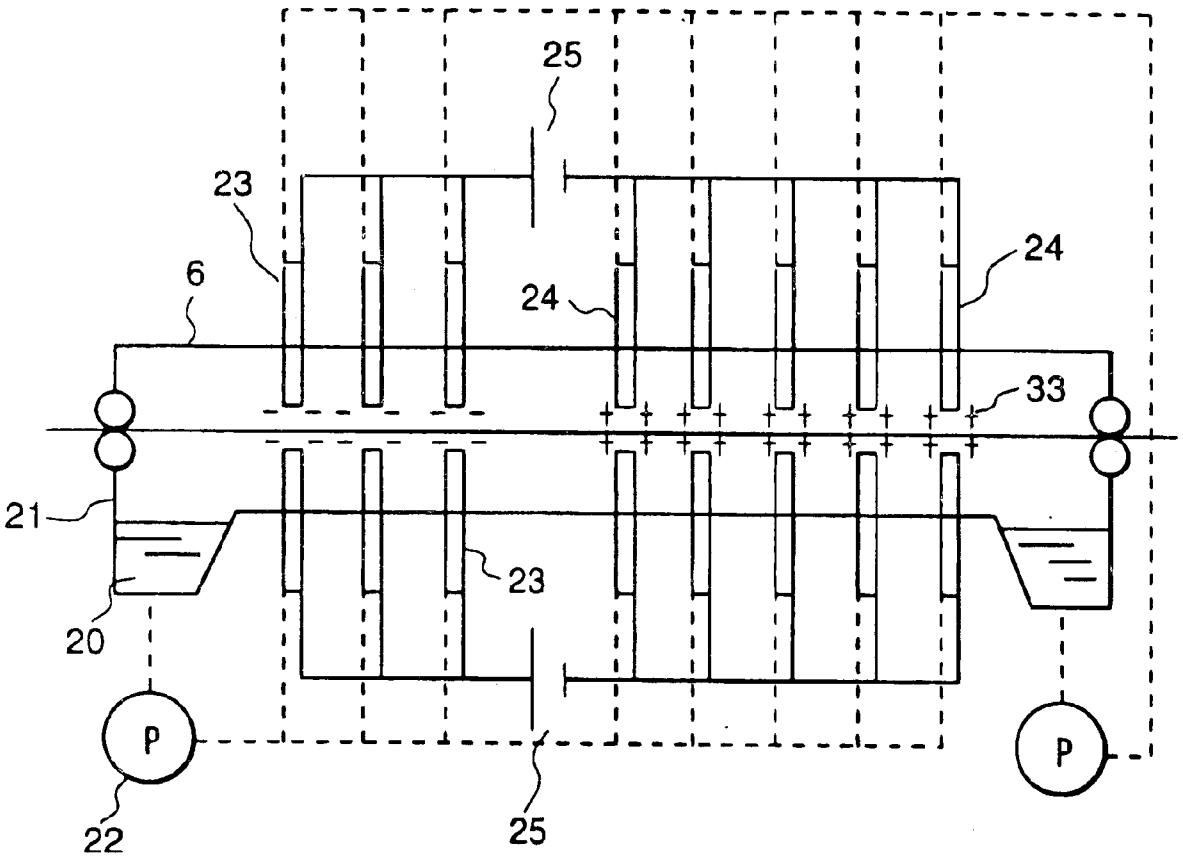
FIG. 2 shows neutral salt solution electrolysis part of FIG. 1 in greater detail.

The neutral salt solution electrolysis part 6 is explained in detail, in FIG. 2 as representative of the parts 6, 8, 10 that are structurally identical with respect to the detail shown in the disclosure.

The neutral salt solution electrolysis part 6 comprises an electrolyte tank 21 storing the neutral salt solution 20, a pump 22 that pressurizes the neutral salt solution 20, anodes 23 and cathodes 24 that also serve as a nozzle, and power 25 connected to the anodes 23 and the cathodes 24. The anodes 23 are arranged in the upstream region relative to the movement direction of the steel strip 1, and the cathodes 24 are arranged in the downstream region, on both sides of the steel strip 1. In the respective regions, the electrodes of both sides are the same polarity.

The anodes 23 and the cathodes 24 have jet openings 26 that jet neutral salt solution 20 to the steel strip 1. That is, the anodes 23 and the cathodes 24 are integrating with the nozzles that jet the neutral salt solution 20. The neutral salt solution 20 in the electrolyte tank 21 is pressurized by the pump 22 and is jetted on both sides of steel strip 1 from the jet openings 26 of the anodes 23 and the cathodes 24. Thereby both sides of steel strip 1 are covered by a film of the neutral salt solution 20. The excessive neutral salt solution 20 returns to the electrolyte tank 21.

In the example 1, by descaling the steel strip 1 without immersing in the neutral salt solution 20, the quantity of the neutral salt solution 20 is small.

Therefore, as the size of the electrolyte tank is reduced, it is possible to miniaturize the descaling apparatus.

Figure 3A:
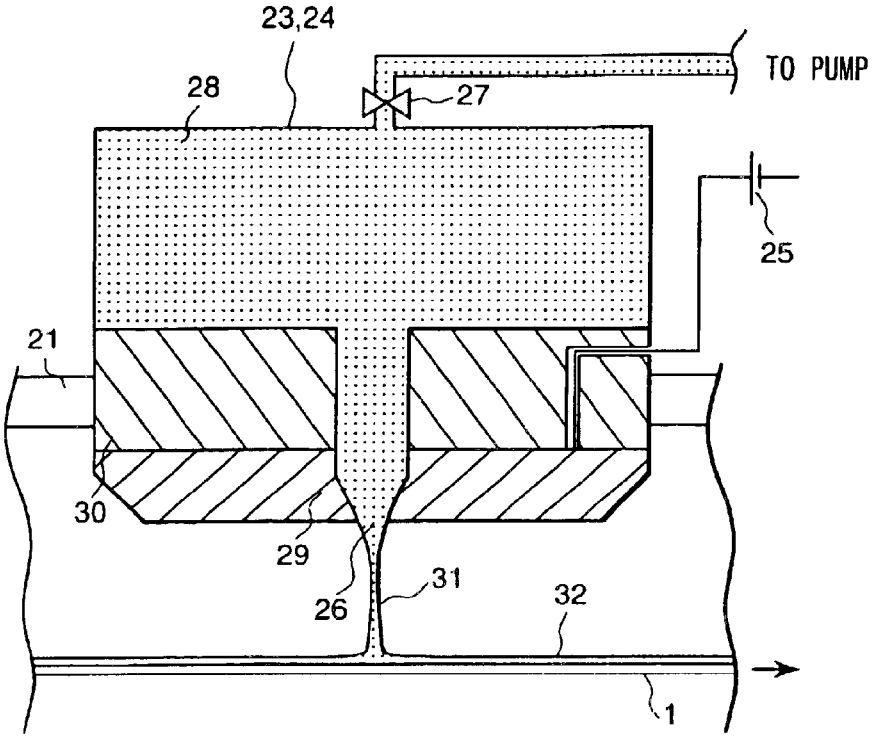
FIG. 3A and FIG. 3B shows the electrode in detail and in plan view, respectively.

FIG. 3A shows the anode 23 of FIG. 1 in detail.

Figure 3B:
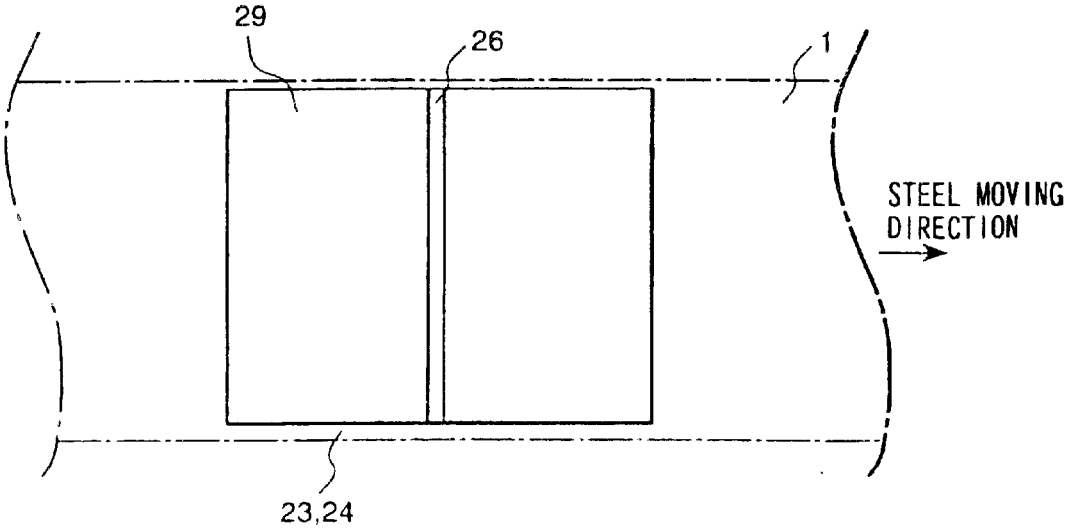

The anode 23 has a pressure adjustment valve 27 that adjusts a jet pressure, a liquid receiver 28 storing the neutral salt solution 20 supplied from the pump 22 through the pressure adjustment valve 27, and an electrical conductor 29 connected with the power supply 25. The liquid receiver 28 and the conductor 29 are separated by an electric insulating material 30 so that the anode 23 is insulated from the electrolyte tank 21. The jet opening 26 is long in the direction of according to the width of the steel strip 1, as shown in FIG. 3B.

The neutral salt solution 20 drawn from the electrolyte tank 21 by the pump 22 is stored under adjusted pressure for a while in the liquid receiver 28 and is jetted from the jet opening 26 to the steel strip 1. With the pressure adjustment valve 27, we can adjust the jet pressure of the neutral salt solution 20 to the steel strip 1 individually for each electrode.

In this example, we adjust the pressure of the electrolyte independently to the both sides of the steel strip 1 properly in order to prevent the flexure of the steel strip 1. Because the steel strip 1 does not have flexure, we can arrange the anodes 23 and the cathodes 24 close to the steel strip 1. Since the distance between the electrodes (the anodes 23 and the cathodes 24) and the steel strip 1 thereby became short, the voltage drop in the distance became small, and the voltage applied to the electrodes became lowered. Therefore, the total electric power for the electrolysis is reduced.

We have brought the anodes 23 and the cathodes 24 as close as 1 cm to the steel strip 1 in practice. The distance is 1/10 or less as compared with the conventional electrolysis submerging steel strip. As a result, the electrolytic efficiency improves 65–95% or more compared with the prior art. Therefore, we reduce the voltage from 20V to 7V or less to obtain the same electric current density of $20A/cm^2$ as the prior art.

Next, a flow of the electric current in the neutral salt solution electrolysis part 6 is explained with respect to FIG. 2.

The power supply 25 applies a voltage between the anodes 23 and the cathodes 24. On the one hand the surface of steel strip 1 between the cathodes 24 becomes negatively charged, on the other hand the surface between the anodes 23 becomes positively charged. The electric current of power supply 25 flows to the negative charged part of the steel strip 1 through the jet stream 31(FIG. 3A) from the anode 23 and the neutral salt solution film 32 that covers the surface of the steel strip 1. Next, through the inside of steel strip 1, the electric current flows to the positive charged part between the cathodes 24, and then, through the neutral salt solution film 32 and the jet streams 31 of the cathodes, the electric current returns to the power supply 25 through suitable wiring to provide a closed series circuit independent of the bath.

In the conventional electrolysis, because the anodes 23 and the cathodes 24 were arranged immersed in the neutral salt solution 20 the short-circuit current flowed between the anodes 23 and the cathodes 24 through the bath of the neutral salt solution 20 to result in a lot of loss of the electric current. Compared with the conventional electrolysis, however, in this invention the short-circuit current between the anodes 23 and the cathodes 24 decreases very much, since the route of short-circuit current is limited to only the film 32, and the electric power efficiency improves.

The positive charged part of the steel strip 1 between the cathodes 24 locally becomes an anode 33 (FIG. 2), and on the anode 33 chrome oxide in the oxide film ionizes according to the chemical reaction (1) and dissolves in the neutral salt solution 20.

$$Cr_2O_3+4H_2O \rightarrow Cr_2O_7^{2-}+8H^++6E \quad (1)$$

The oxide chrome ions dissolved in the neutral salt solution 20 fall in the electrolyte tank 21 and the chrome oxide is eliminated from the surface of the steel strip 1.

On the surface of steel strip 1 between the anodes 23, chrome oxide separates out according to the adverse chemical reaction to the reaction (1). The arrangement of the anodes 23 to the upper stream side and the cathodes 24 to the downstream side respectively, prevents from separating out again by the reduction similar to the conventional electrolysis.

As there are a lot of anodes 23 and cathodes 24, the electric current to the steel strip 1 is large. Therefore, a lot of anodes 23 and cathodes 24 increase the electric current density in the steel strip 1 and thereby improve the descaling speed. In this example, since we increased the number of cathodes 24 in order to improve the descaling speed, the anode 33 provided the electric current density enough to properly descale.

Because the neutral salt solution 20 contacts conductor 29 immediately surrounding in jet opening 26, we supply the large electric current to the steel strip 1 constantly through the jetstreams 31 of the salt solution 20 without interruption. Therefore, as the electric current density of the steel strip 1 is large, we can descale rapidly and uniformly.

Likewise with the neutral salt solution electrolytic part 6, in the alkali solution electrolysis part 8 and the nitrate solution electrolytic part 10, descaling is performed by jetting the electrolyte and electrolysis with the anodes 23 and the cathodes 24.

Table 1 shows the total electrolyte quantity, the total electric energy and the maximum line speed of the example 1, compared with the conventional electrolysis submerging steel strip.

TABLE 1

| | Conventional | Present Invention |
|---|---|---|
| total electrolyte quantity(neutral salt + nitrate) | 1 | 0.3 |
| total electric energy | 1 | 0.4 |
| maximum line speed | 1 | 1.5 |

The total electrolyte quantity is about 30% and the total electric energy is 40% or less of the conventional electrolysis. The maximum line speed improves 50% in comparison with conventional electrolysis. Jetting has an effect of peeling off the scale and contributes to the improvement of the line speed.

EXAMPLE 2

The steel strip manufacturing apparatus according to the second example of the present invention is explained with respect to FIG. 4A to FIG. 4D, wherein steel strip is an annealed normal steel with mainly $Fe_2O_3$ and $Fe_3O_4$ formed on the surface.

Figure 4A:
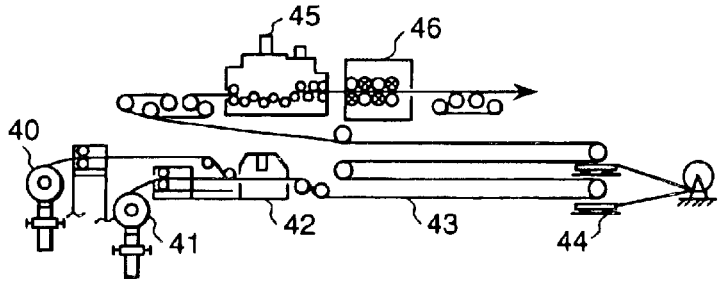
FIGS. 4A to 4D show normal steel strip manufacturing apparatus of the second example.

In FIG. 4A, the steel strips wound on the inlet coil cars 40 and 41 are duet joined together by a welder 42 and fed out continuously.

Next, the steel strip 43 passes to the mechanical scale breaker 45 via the loop car 44. In the mechanical scale breaker 45, breakages are formed to the scale of the steel strip 43, and then the broken scales are rubbed off with the mechanical brush 46.

Figure 4B:
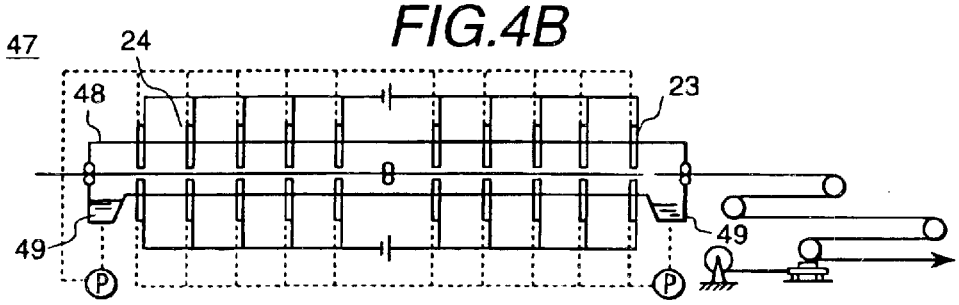

After these processes, the steel strip 43 passes through the descaling apparatus 47 in FIG. 4B, which has the structural details of FIGS. 2, 3A and 3B. The descaling apparatus 47 has a hydrochloride electrolysis part 48 using hydrochloric acid 49 as an electrolyte. In hydrochloride electrolysis pat 48, the cathodes 24 are arranged in a first upstream half, and the anodes 23 are arranged in the latter downstream half.

The chemical reactions in the hydrochloride electrolysis cell part 48 are the following;
(on the cathodes)

$$Fe_2O_3+6H^++2E\rightarrow 2Fe_2{}^++3H_2O \quad (2)$$

$$Fe_3O_4+8H^++2E\rightarrow 2Fe_2{}^++4H_2O \quad (3)$$

(on the anodes)

$$Fe\rightarrow Fe_2{}^++2E \quad (4)$$

The hydrochloride density is 180 G/L, which is the same as the conventional electrolysis, and the temperature is 85° C.

According to the chemical reactions (2) and (3) on the cathode 24, the scale dissolves and is removed from the steel strip 1. According to the chemical reaction (4) on the anode 23, the foundation (normal steel) dissolves, and as a result the scale exfoliates from steel strip 43. While the electric current density has a preferred value according to by a steel kind such as a normal steel and a stainless steel, or a size of the steel, it is preferred to control the electric current density in the range of the 1–20 A/cm$^2$ generally.

Figure 4C:
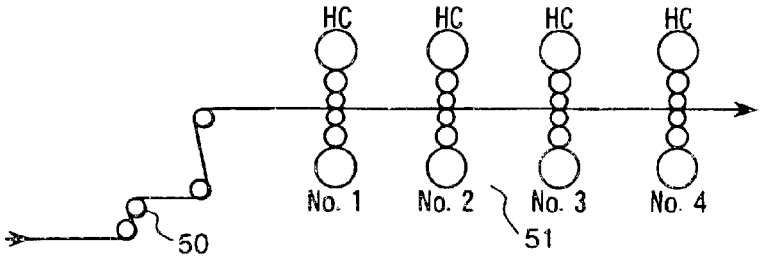
Figure 4D:
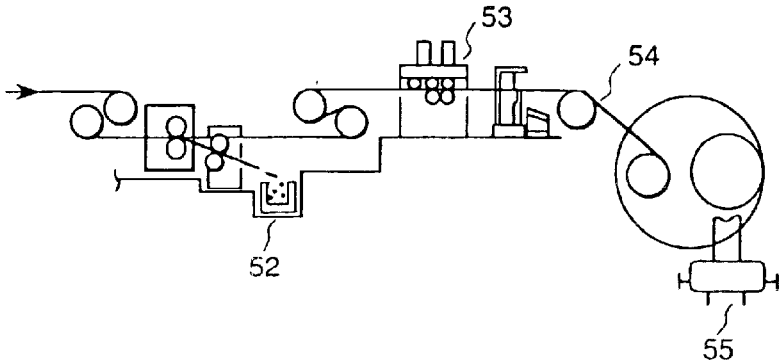

The steel strip 43 passes through the mill stand 51 via the centering apparatus 50 in FIG. 4C. The steel strip 43 is cold-rolled by the HC mill of No. 1–4, and it is manufactured to thin plate. In FIG. 4D, the thin plate steel strip 43 passes through the rotary type scrap chopper 52 and the oiler 53 and is wound on the outlet coil car 54.

According to the example 2, jetting the hydrochloric acid 49 in the air reduces the quantity of the hydrochloric acid 49, to miniaturize the hydrochloride electrolytic part 48 and thereby to miniaturize the manufacturing apparatus similar to the example 1.

According to the example 1 and 2, by adjusting the jet pressure of the electrolyte to both sides of the steel strip 1, 43, the waving and the flexure of the steel strip 1, 43 are prevented, and so it is possible to arrange the anodes 23 and the cathodes 24 close to the steel strip 1, 43. Therefore, as the voltage drop between the electrodes and the steel strip 43 becomes lower, the electric power for the descaling decreases similar for bath to the examples 1 and 2.

According to the example 2, compared with the conventional electrolysis, since the short-circuit current between the anodes 23 and the cathodes 24 decreases very much, the electric power efficiency improves similar to the example 1.

According to the example 2, because the electrode is integrated with the nozzle that jets the hydrochloric acid 49, supply of the large electric current to the steel strip 43 through the jetted electrolyte, similar to the example 1.

Therefore, as the electric current density of the steel strip 43 is large, the descaling rapidly similar to the example 1. Providing many electrodes improves the descaling speed more because the electric current to the steel strip 43 increases similar to the example 1.

Figure 5A:
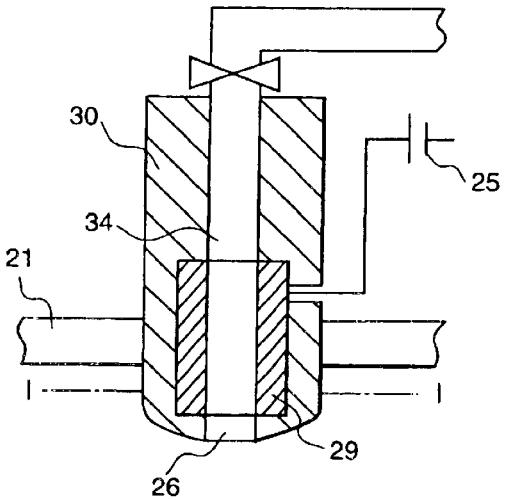
FIG. 5A and FIG. 5B show another example of electrode in detail and in sectional view, respectively.
Figure 5B:
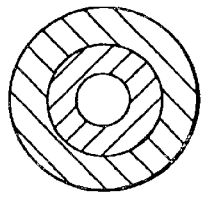

Another example of the electrodes 23, 24 is explained with respect to FIG. 5. A conductor 29 is placed at a electrolytic passage way 34, and an electric insulating material 30 covers an end of the electrodes 23, 24. As FIG. 5B show, the electric insulating material 30 surrounds the conductor 29, which surrounds the electrolytic passage way 34. The electric insulating material 30 prevent a discharge between the electrodes and the steel strip when the electrodes 23, 24 contact the steel strip and we can protect the steel strip against damage by the discharge.

Figure 6:
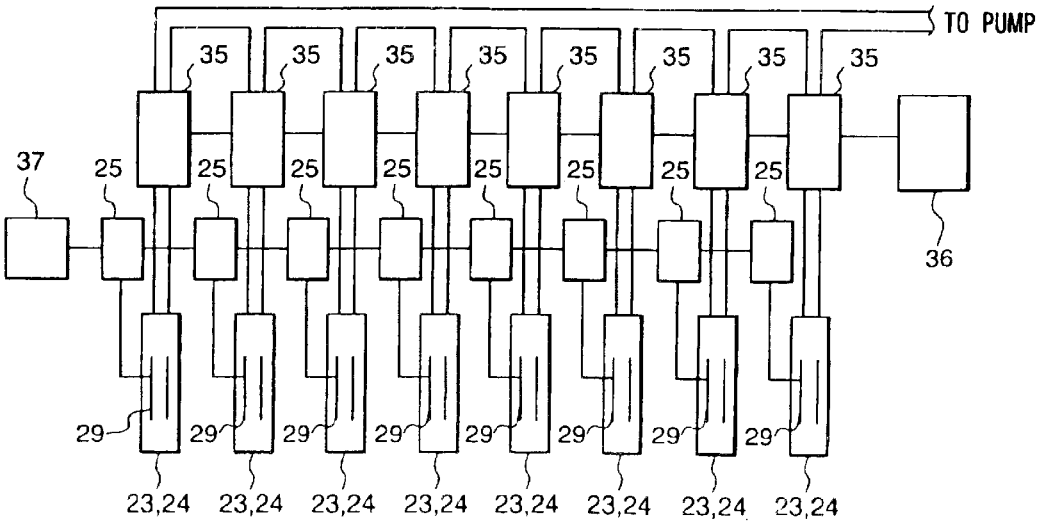
FIG. 6 shows an example of power supply systems and jet adjusting systems.

Other examples of jet force adjustment by electrolyte pressure adjustments are explained with respect to FIG. 6, which shows an arrangement of them on one side of the steel strip.

Each electrode 23 (or 24) connects a pressure adjustment element 35 and every pressure adjustment element is connected to a controller 36 which controls the respective pressures. Each electrode 23 (or 24) is also connected to a power supply 25 and a controller 37 controls the power for each power supply, respectively.

Figure 7:
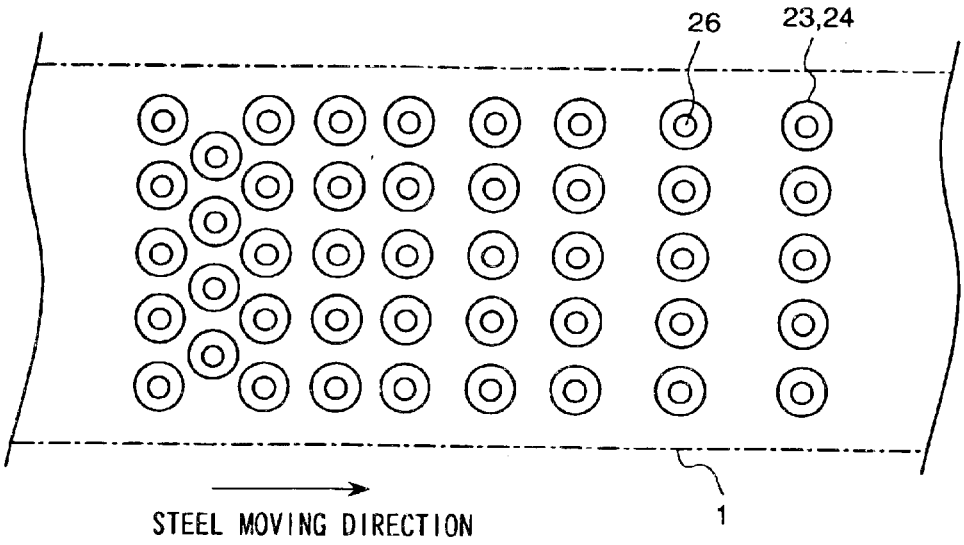
FIG. 7 shows an example of electrodes arrangement in plan view.

Thereby we can control a jet pressure of the electrolyte, voltage and polarity applied to the conductor 29 according to a kind of steel or electrolyte and control an extent of descaling. Because a descaling reaction advances more at a downstream region, altering a distribution of electrodes 23, 24 in FIG. 7 is suitable to coordinate the descaling.

What is claimed is:

1. A steel strip descaling method for descaling with an electrolyte comprising:

a step for holding the steel strip so that the steel strip is not submerged in the electrolyte;

a step for jetting the electrolyte to the steel strip;

a step for applying voltage to a jetting electrolyte, wherein a jet of the electrolyte passing through air to the steel strip electrically contacts with the steel strip; and passing a constant electric current between the jet of electrolyte and the steel strip so that chrome oxide film on said steel strip ionizes by chemical reaction and dissolves in the electrolyte.

2. A steel strip descaling method according to claim 1 further comprising, a step of adjusting pressure of the jetted electrolyte so that a length of the jet of electrolyte passing through air to the steel is constant.

3. A steel strip descaling method for descaling a steel strip with an electrolyte, comprising the steps of:

storing an electrolyte solution in an electrolyte tank;

pressurizing the solution to pass the solution through openings in jet streams onto both surfaces of said steel strip; and applying an electric potential to make an electrical circuit that passes through the jet streams and on each surface of said steel strip so that chrome oxide in an oxide film on said steel strip ionizes by chemical reaction and dissolves in the electrolyte solution.

4. A steel strip descaling method according to claim 3, further including:

adjusting the pressurizing of the electrolyte solution that is jetted through said electrolyte jet openings.

* * * * *